US007478867B2

(12) United States Patent
Weng

(10) Patent No.: US 7,478,867 B2
(45) Date of Patent: Jan. 20, 2009

(54) BREASTFEEDING CHAIR

(76) Inventor: Chi-Nan Weng, No. 37, Ming-Ching 3rd St., Hsin-Ying City, Tainan Hsien (TW)

( * ) Notice: Subject to any disclaimer, the term of this patent is extended or adjusted under 35 U.S.C. 154(b) by 520 days.

(21) Appl. No.: 11/187,156

(22) Filed: Jul. 23, 2005

(65) Prior Publication Data

US 2007/0029850 A1 Feb. 8, 2007

(51) Int. Cl.
*A47B 83/02* (2006.01)

(52) U.S. Cl. ..... 297/161; 297/170; 297/188.14

(58) Field of Classification Search ..... 297/161, 297/162, 188.14, 188.15, 170, 284.4, 423.28
See application file for complete search history.

(56) References Cited

U.S. PATENT DOCUMENTS 4,455,050 A * 6/1984 Kubek ..... 297/423.28 X
5,171,064 A * 12/1992 Boussaroque ..... 297/284.4 X
5,765,911 A * 6/1998 Sorenson ..... 297/161 X
6,059,357 A * 5/2000 Peart ..... 297/161 X
6,412,862 B1 * 7/2002 Dickerson et al. ..... 297/188.14
6,425,631 B1 * 7/2002 Lin ..... 297/170

* cited by examiner

*Primary Examiner*—Anthony D. Barfield
(74) *Attorney, Agent, or Firm*—Ladas & Parry, LLP

(57) ABSTRACT

A breastfeeding chair includes a baby rest unit mounted adjustably on an armrest unit. The baby rest unit includes a support rod, an extension arm and a baby rest member. The support rod is mounted on a front end of the armrest unit and is movable upward and downward for height adjustment. The extension arm is mounted rotatably on the support rod and is turnable upward and downward to adjust an inclined angle with respect to a horizontal direction. The baby rest member is mounted on the extension arm opposite to the support rod and is pivotable to move forward and backward relative to the front end of the armrest unit.

13 Claims, 7 Drawing Sheets

BREASTFEEDING CHAIR

BACKGROUND OF THE INVENTION

1. Field of the Invention

The present invention relates to a chair, more particularly to a breastfeeding chair.

2. Description of the Related Art

For a mother, breastfeeding a baby takes at least half an hour and can even last for a couple of hours. During breastfeeding, the mother's pose is maintained static so as not to affect the baby's feeding. With the baby in her arms, a chair with or without armrest members provides the mother very little support. Therefore, conventional chairs require improvement in design to take into consideration those people that have breastfeeding needs.

SUMMARY OF THE INVENTION

The object of the present invention is to provide a breastfeeding chair that can overcome the aforesaid drawback associated with the prior art.

Accordingly, a breastfeeding chair of the present invention comprises a base support, a seat unit, an armrest unit and a baby rest unit.

The seat unit is fixedly mounted on top of the base support, and includes a seat member and a backrest member extending upwardly from a rear side of the seat member.

The armrest unit is provided on two sides of the seat unit.

The baby rest is mounted adjustably on the armrest unit, and includes a support rod, an extension arm and a baby rest member. The support rod is mounted on a front end of the armrest unit and is movable upward and downward for height adjustment. The extension arm is mounted rotatably on the support rod, and is turnable upward and downward to adjust an inclined angle with respect to a horizontal direction. The baby rest member is mounted on the extension arm opposite to the support rod, and is pivotable to move forward and backward relative to the front end of the armrest unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
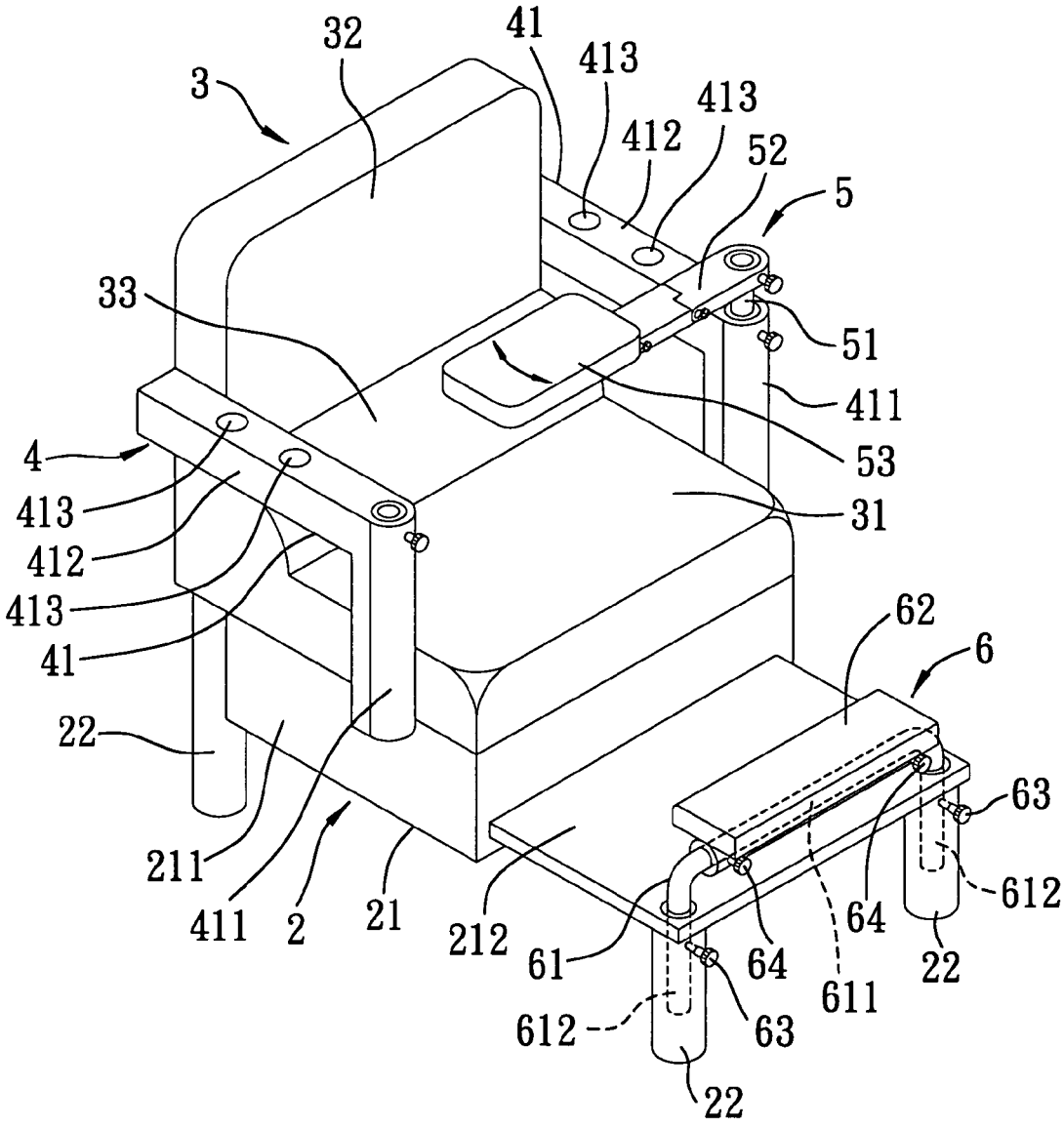
FIG. 1 is an assembled perspective view of the preferred embodiment of a breastfeeding chair according to the present invention.

Referring to FIG. 1, the preferred embodiment of a breastfeeding chair according to the present invention is shown to include a base support 2, a seat unit 3, an armrest unit 4, a baby rest unit 5 and a footrest unit 6.

The base support 1 is adapted for standing on a ground, and includes four legs 22 and a base 21 mounted on the legs 22. The base 21 includes a rectangular seat base 211, and an extension member 212 movably inserted into the seat base 211 and extending forwardly from the seat base 211. The extension member 212 is extendible and retractable so that the base 21 has a variable length along a front-to-rear direction. Two of the legs 22 are disposed at rear corners of the seat base 211 and spaced apart from each other. The other two legs 22 are disposed at front corners of the extension member 212 and spaced apart from each other.

The seat unit 3 is fixedly mounted on top of the seat base 211, and includes a seat member 31 and a backrest member 32 extending upwardly from a rear side of the seat member 31. In this embodiment, the seat unit 3 further comprises a waist support member 33 provided between the backrest member 32 and the seat member 31. The backrest member 32 and the seat member 31 form an angle of about 90 degrees therebetween.

The armrest unit 4 is provided on two sides of the seat unit 3. The armrest unit 4 includes two armrest members 41. Each of the armrest members 41 is connected to the seat member 31 and the backrest member 32 on the same side, and includes an upright bar 411 mounted on one side of the seat member 31, and a horizontal bar 412 extending rearwardly from a top side of the upright bar 411 and connected to the backrest member 32. At least one of the horizontal bars 412 of the armrest members 41 has a top side formed with a retaining hole 413 for retaining an object, such as a milk bottle. In this embodiment, there are two pairs of retaining holes 413, each pair of which are formed in one of the horizontal bars 412. In practice, the number and the location of the retaining holes 413 should not be limited to what is disclosed herein.

The baby rest unit 5 is mounted adjustably on a selected armrest member 41 of the armrest unit 4, and includes a support rod 51, an extension arm 52 and a baby rest member 53. The support rod 51 is mounted on a front end of the armrest unit 4 and movable upward and downward for height adjustment. In this embodiment, the baby rest unit 5 is mounted on the left armrest member 41. In practice, the baby rest unit 5 may be as well mounted on the right armrest member 41 depending on the requirements of the user. The extension arm 52 is mounted rotatably on the support rod 51 and is turnable upward and downward to adjust an inclined angle with respect to a horizontal direction. The baby rest member 53 is mounted on the extension arm 52 opposite to the support rod 51 and is pivotable to move forward and backward relative to the front end of the armrest unit 4.

The footrest unit 6 is mounted on a front edge of a top side of the extension member 212 of the base support 2, and includes a footrest frame 61 which is extendible and retractable therefrom, and a footrest member 62 sleeved rotatably on the footrest frame 61. The footrest frame 61 is in an inverted-U shape, and includes a horizontal frame rod 611, and a pair of vertical rods 612 extending downwardly from two ends of the horizontal frame rod 611 and inserted respectively into the front legs 22.

The footrest unit 6 further includes a pair of clamping screws 63 extending threadedly into the respective front legs 22 to abut against the respective vertical rods 612 for positioning releaseably the vertical rods 612. Another pair of clamping screws 64 extend threadedly into the footrest member 62 to abut against the horizontal frame rod 611 so as to position releaseably the footrest member 62 to the horizontal frame rod 611. The vertical rods 612 are movable upward and downward for adjusting the height of the footrest frame 61 before positioned by the clamping screws 63. The footrest member 62 is pivotable about the horizontal frame rod 611 to adjust a slope thereof and can be immobilized by tightening the clamping screws 64. Since there are many alternative designs for positioning the footrest frame 61 and the footrest member 62, further details will be omitted herein for the sake of brevity.

Figure 2:
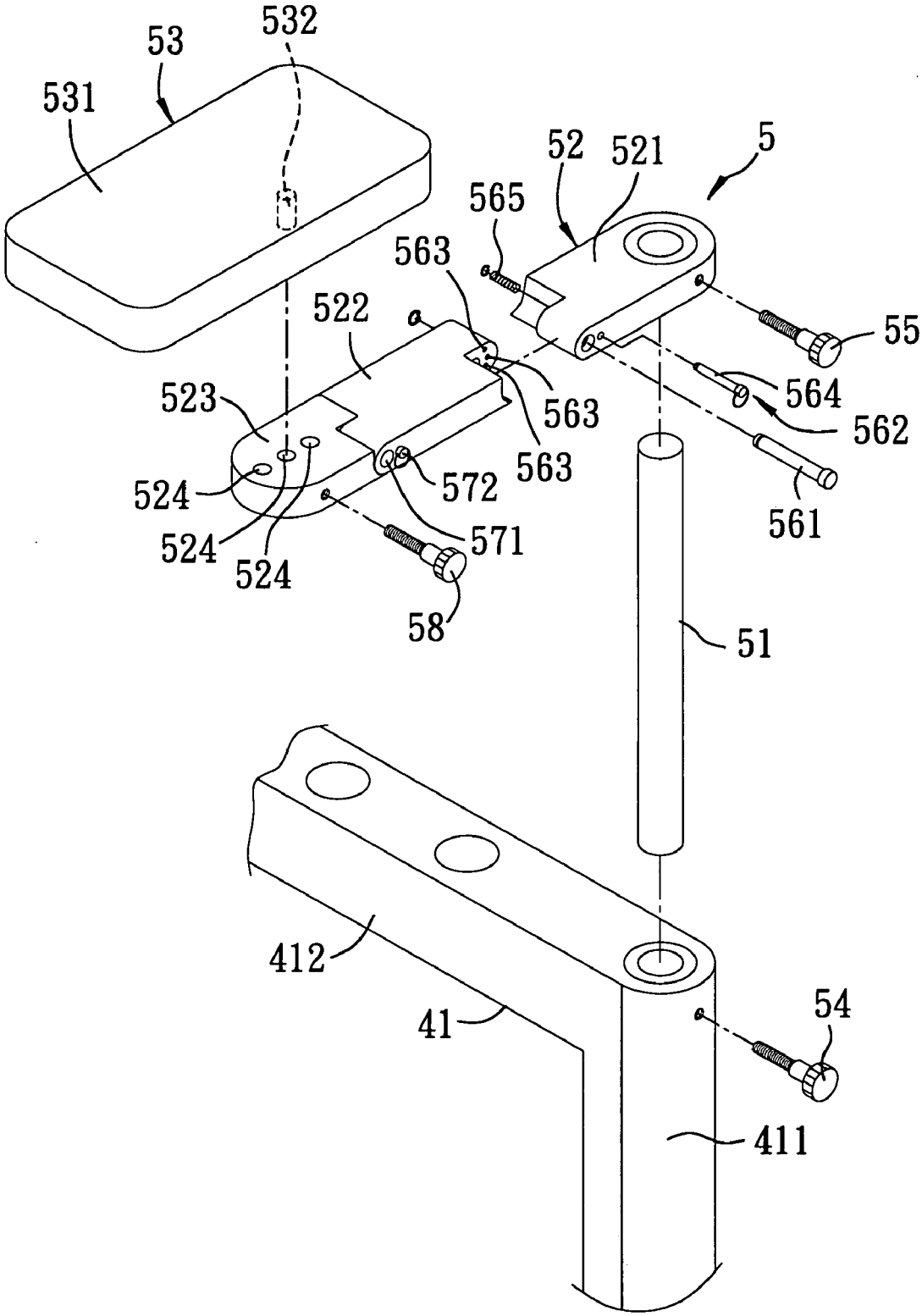
FIG. 2 is a fragmentary exploded perspective view of the preferred embodiment for illustrating coupling between an armrest unit and a baby rest unit.
Figure 3:
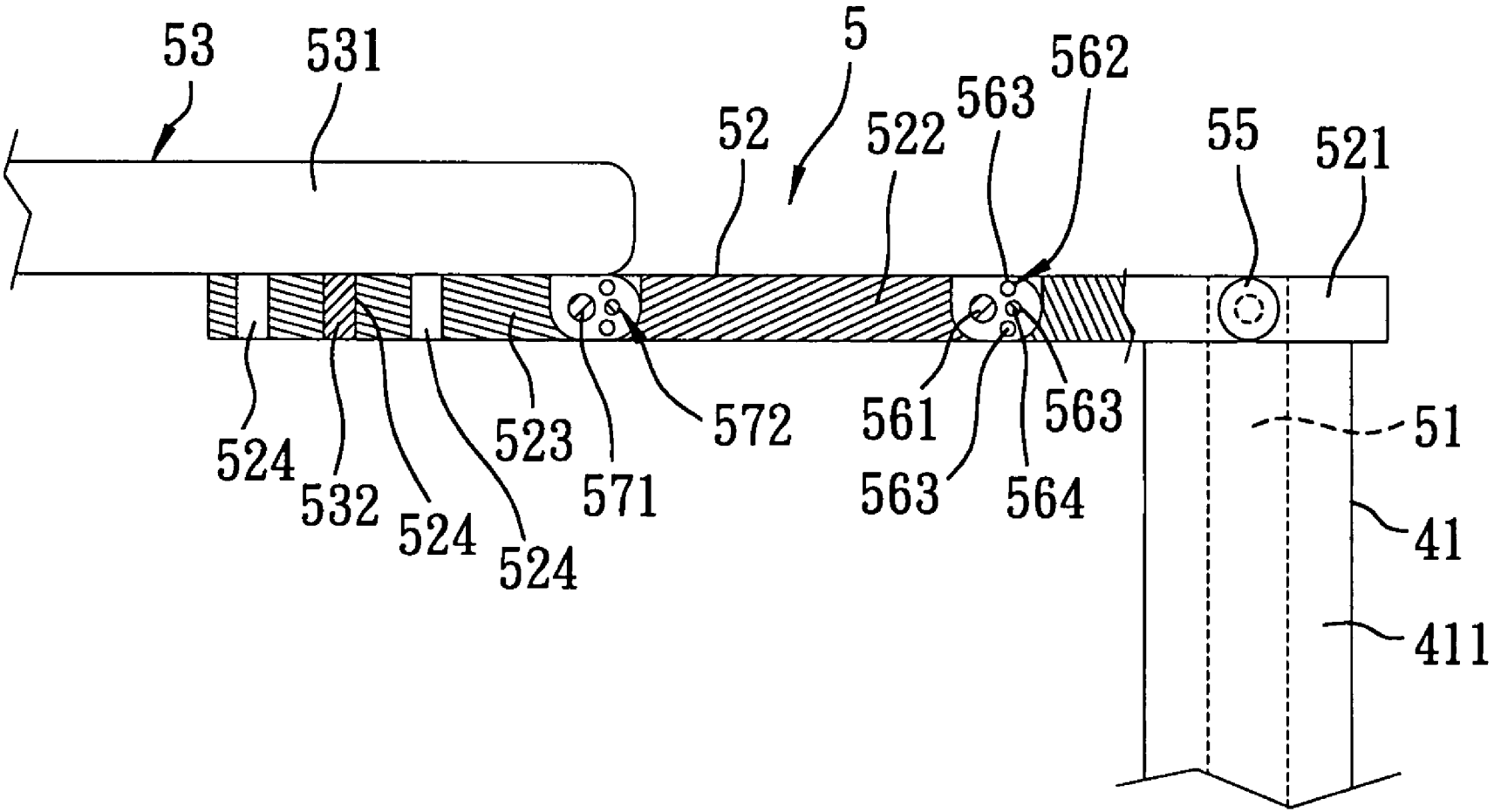
FIG. 3 is a side view of a portion of the baby rest unit in a horizontally extending position.
Figure 4:
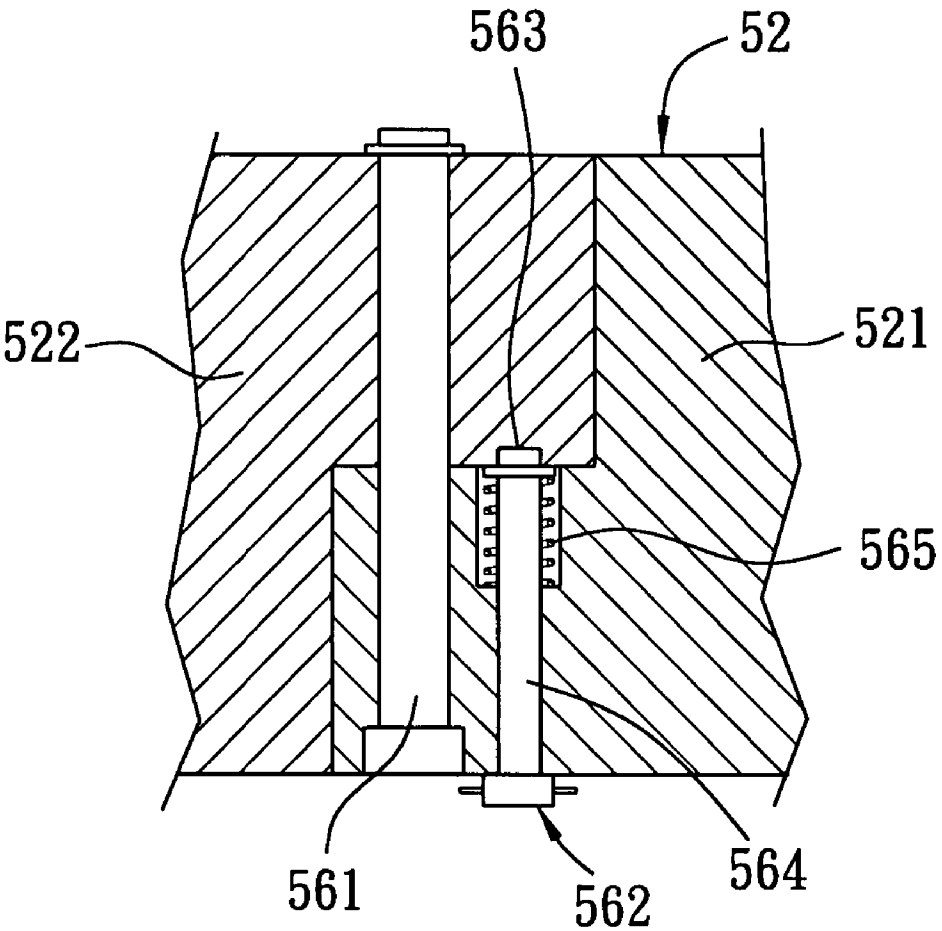
FIG. 4 is a fragmentary sectional view of the baby rest unit for illustrating coupling between a first arm segment and a second arm segment thereof.

Referring to FIGS. 2, 3 and 4, the support rod 51 of the baby rest unit 5 is inserted into the upright bar 411 of the left armrest member 41 and is movable upward and downward relative to the armrest member 41. The armrest member 41 further has a clamping screw 54 extending threadedly into the upright bar 411 to abut against the support rod 51 so that the support rod 51 is held fixedly against the armrest member 41.

The extension arm 52 of the baby rest unit 5 includes a first arm segment 521 rotatably sleeved onto a top end of the support rod 51, and a locking element 55 threadedly inserted into the first arm segment 521 to abut against the support rod 51. The extension arm 52 of the baby rest unit 5 further includes a second arm segment 522, and a first pivot axle 561 to pivotably connect the second arm segment 522 to the first arm segment 521 such that the second arm segment 522 is pivotable about the first pivot axle 561 to move upward and downward relative to the first arm segment 521. A first positioning unit 562 is provided to hold the second arm segment 522 at an adjusted angle relative to the first arm segment 521. The first pivot axle 561 is inserted into overlapping parts of the first and second arm segments 521, 522. The first positioning unit 562 includes a first positioning pin 564 movably extending through the overlapping part of the first arm segment 521, a set of spaced apart first positioning holes 563 formed in the overlapping part of the second arm segment 522 around the first pivot axle 561, and a spring 565 disposed inside the first arm segment 521 for urging the first positioning pin 564 to extend into a selected one of the first positioning holes 563. When the first positioning pin 564 is pulled outward to disengage from one of the first positioning holes 563, the second arm segment 522 is pivotable upward and downward about the first pivot axle 561. When the first positioning pin 564 is released, it extends into a selected first positioning hole 563 by virtue of the biasing force of the spring 565, thereby retaining the second arm segment 522 at an adjusted angle relative to the first arm segment 521.

The extension arm 52 of the baby rest unit 5 further includes a third arm segment 523, a second pivot axle 571 to pivotably connect the third arm segment 523 to the second arm segment 522 such that the third arm segment 523 is movable relative to the second arm segment 522, and a second positioning unit 572 for holding the third arm segment 523 at an adjusted angle relative to the second arm segment 522. Since the structure and operation of the second positioning unit 572 are identical to those of the first positioning unit 562, details of the second positioning unit 572 are omitted herein for the sake of brevity.

Figure 5:
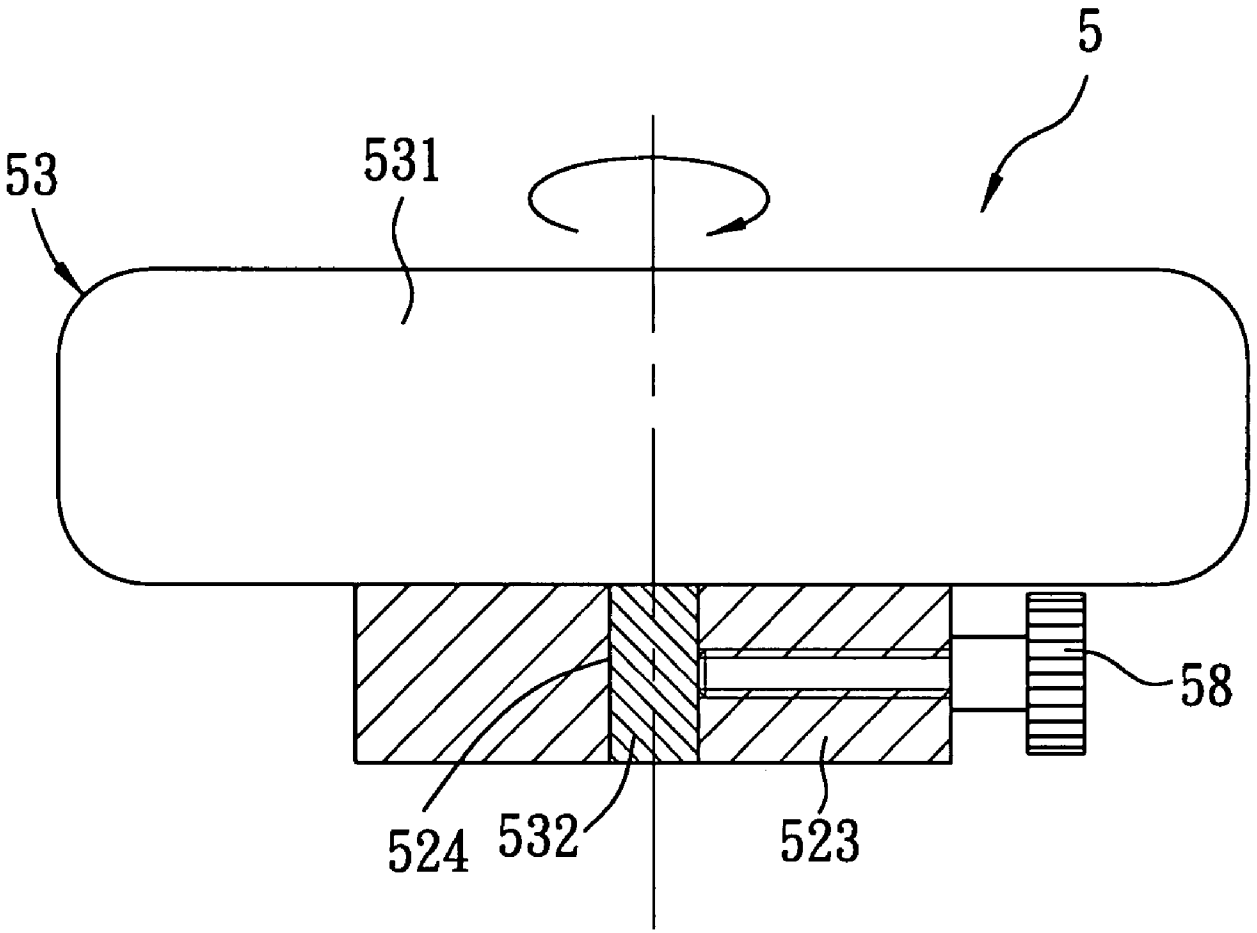
FIG. 5 is a fragmentary view of the baby rest unit for illustrating a baby rest member pivotable relative to an extension arm thereof.

Referring to FIG. 5 in combination with FIG. 2, the third arm segment 523 of the extension arm 52 is formed with a set of through holes 524. The baby rest member 53 includes a cushion member 531 disposed on the third arm segment 523, and an insertion rod 532 projecting from the cushion member 531 and inserted into one of the through holes 524 of the third arm segment 523. An anchoring stud 58 is inserted threadedly into the third arm segment 523 to abut against the insertion rod 532. The insertion rod 532 is insertable into a selected one of the through holes 524 and is rotatable relative to the third arm segment 523 so that the position of the cushion member 531 may be changed or adjusted relative to the third arm segment 523. The position of the cushion member 531 is fixed when the anchoring stud 58 is tightened. It is noted that there are many other alternative positioning mechanisms suitable for application in this invention. Hence, actual implementation should not be limited to what is disclosed herein.

Figure 6:
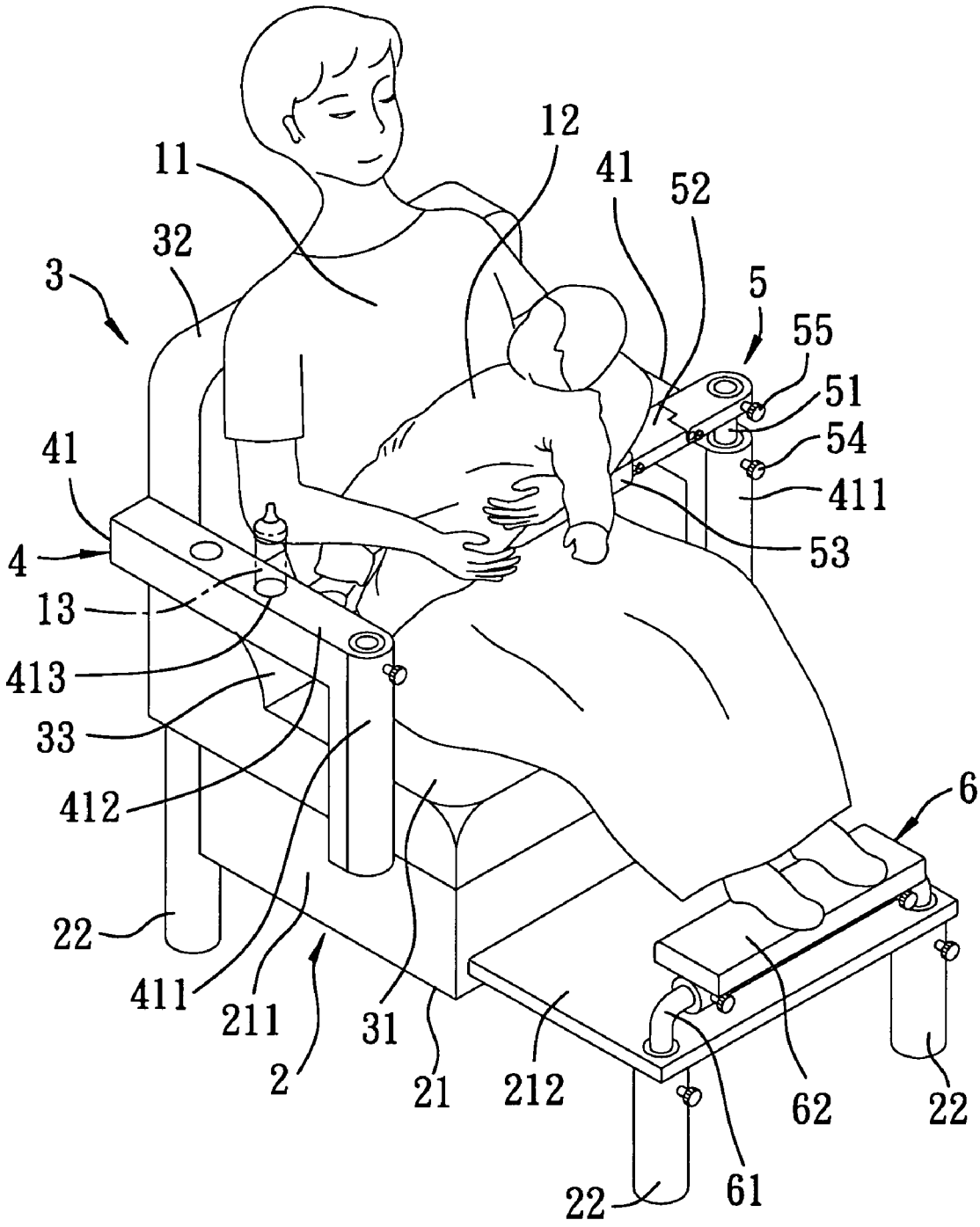
FIG. 6 is a perspective view of the preferred embodiment in a state of use.
Figure 7:
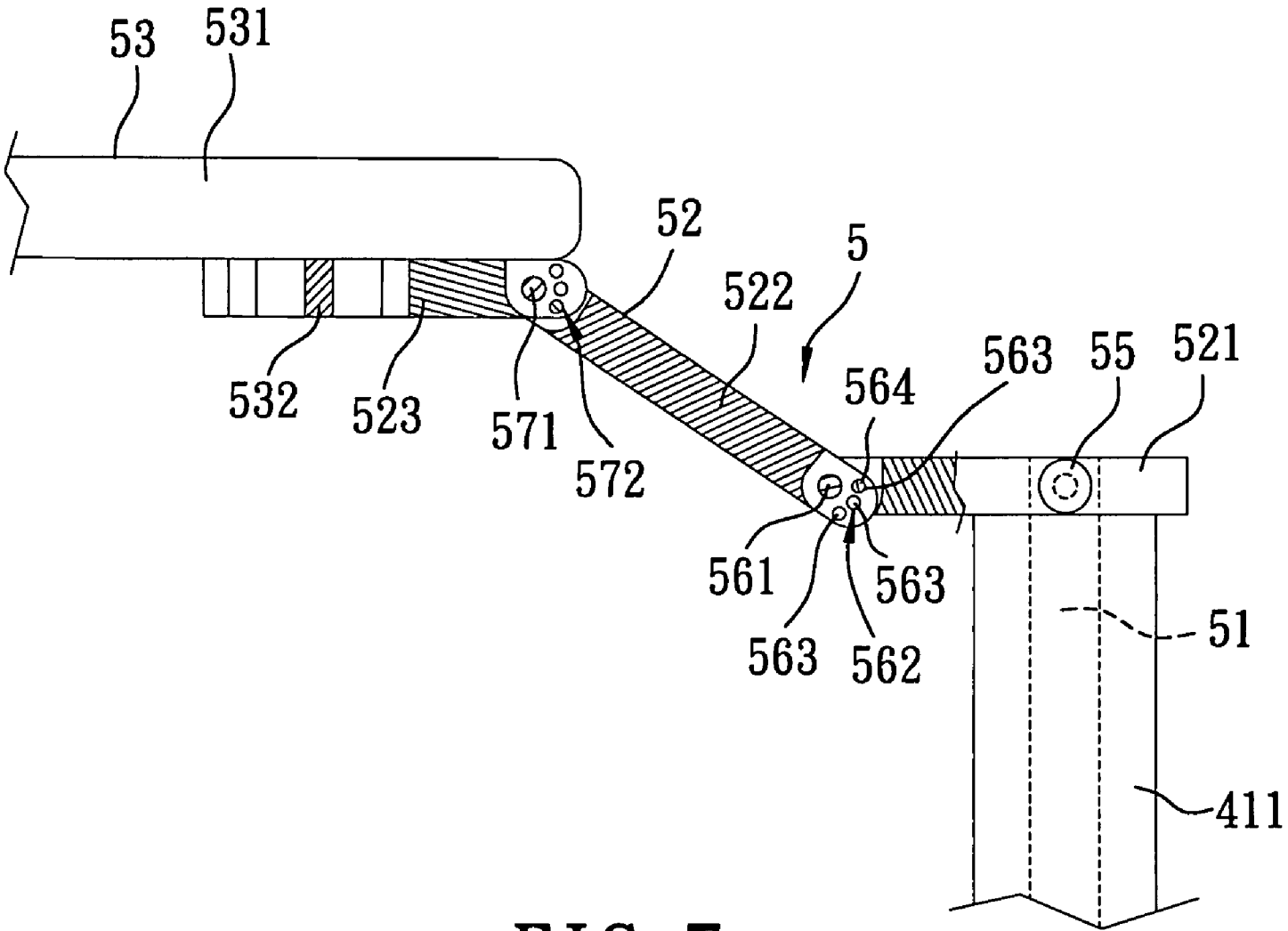
FIG. 7 is a side view similar to FIG. 3 but illustrating that the extension arm is turned to raise the baby rest unit.

Referring once again to FIGS. 2 and 6, when a user 11 intends to use the breastfeeding chair of this invention, the baby rest unit 5 is first installed on the left or right armrest member 41 depending on the user's habit. Next, according to the height and the habitual breastfeeding pose of the user 11, the height of the support rod 51 is adjusted and is thereafter fixed using the clamping screw 54. Then, the angle of the extension arm 52 relative to the support rod 51 is adjusted and fixed using the locking element 55, and the inclined angle of the extension arm 52 relative to a horizontal line is adjusted using the first and second positioning units 562, 572, as shown in FIG. 7. Further, the cushion member 53 is turned forward or backward to a desired position and is fixed thereat using the anchoring stud 58. After completing all adjustments, the user may sit on the seat unit 3 with her baby 12 placed on her arms. As the arm which carries the baby is well supported by the baby rest unit 5, the user is able to maintain the same breastfeeding pose for a long time without growing tired.

Moreover, to enhance user comfort, the positions of the extension member 212 and the footrest unit 6 are adjusted such that the user 11 is able to place her feet in the most comfortable position over the footrest member 62. Furthermore, objects for breastfeeding, such as a milk bottle 13, can be retained in the retaining holes 413 for ready access.

It is worth to note that the base 21 may be configured to have a fixed length along the front-to-rear direction, and that the base support 2 may be provided with other suitable configurations which permit stable support on the ground.

Moreover, although the waist support member 33 is provided in this embodiment, in practice, the waist support member 33 is optional and may be dispensed with. In addition, the seat member 31 and the backrest member 32 may be arranged such that the angle therebetween is adjustable.

Furthermore, the armrest members 41 of the armrest unit 4 may be designed such that they are detachable from the seat unit 3. Therefore, when breastfeeding is needed, the baby rest unit 5 may be attached to the armrest unit 4, and the armrest unit 4 maybe re-attached to the seat unit 3. As such, the utility of the breastfeeding chair can be enhanced.

From the foregoing, it is evident that the chair of this invention is convenient to assemble and is comfortable to use. Therefore, the purpose of this invention is served.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A breastfeeding chair comprising:

a base support;

a seat unit fixedly mounted on top of said base support, and including a seat member and a backrest member extending upwardly from a rear side of said seat member an armrest unit provided on two sides of said seat unit; and a baby rest unit mounted adjustably on said armrest unit, said baby rest unit including a support rod mounted on a front end of said armrest unit and movable upward and downward for height adjustment, an extension arm mounted rotatably on said support 15 rod and turnable upward and downward to adjust an inclined angle with respect to a horizontal direction, and a baby rest member mounted on said extension arm opposite to said support rod and pivotable to move forward and backward relative to said front end of said armrest unit, wherein said armrest unit includes an armrest member, said support rod being inserted into and being movable upward and downward relative to said armrest member, said armrest member having a clamping screw extending threadedly into said armrest member to abut against said support rod for positioning releaseably said support rod relative to said armrest member.

2. The breastfeeding chair as claimed in claim 1, wherein said extension arm of said baby rest unit is pivotably sleeved onto a top end of said support rod.

3. The breast feeding chair as claimed in claim 2, wherein said extension arm of said baby rest unit includes a first arm segment rotatably sleeved onto said top end of said support rod, and a locking element threadedly inserted into said first arm segment to abut against said support rod.

4. The breast feeding chair as claimed in claim 3, wherein said extension arm of said baby rest unit further includes a second arm segment, a first pivot axle to pivotably connect said second arm segment to said first arm segment such that said second arm segment is pivotable about said first pivot axle to move upward and downward relative to said first arm segment, and a first positioning unit for holding said second arm segment at an adjusted angle relative to said first arm segment.

5. The breastfeeding chair as claimed in claim 4, wherein said first and second arm segments have overlapping parts, said first pivot axle extending through said overlapping parts, said first positioning unit including a set of spaced apart first positioning holes formed in said overlapping part of said second arm segment and around said first pivot axle, a first positioning pin movably extending through said overlapping part of said first arm segment, and a spring disposed inside said first arm segment for urging said first positioning pin to extend into a selected one of said first positioning holes.

6. The breastfeeding chair as claimed in claim 4, wherein said extension arm of said baby rest unit further includes a third arm segment, a second pivot axle to pivotably connect said third arm segment to said second arm segment such that said third arm segment is pivotable relative to said second arm segment, and a second positioning unit for holding said third arm segment at an adjusted angle relative to said second arm segment.

7. The breast feeding chair as claimed in claim 6, wherein said baby rest member includes a cushion member disposed on said third arm segment, an insertion rod projecting from said cushion member and inserted rotatably into said third arm segment, and an anchoring stud extending threadedly into said third arm segment to abut against said insertion rod.

8. The breast feeding chair as claimed in claim 1, wherein said armrest unit includes two armrest members, at least one of said armrest members having a top side formed with a retaining hole for retaining an object.

9. The breast feeding chair as claimed in claim 1, wherein said base support includes a seat base on which said seat unit is mounted, and an extension member inserted into said seat base and extending forwardly from said seat base.

10. The breastfeeding chair as claimed in claim 9, wherein said extension member is retractable into and extendible outward from said seat base.

11. The breastfeeding chair as claimed in claim 9, further comprising a footrest unit mounted on top of said extension member.

12. The breast feeding chair as claimed in claim 11, wherein said footrest unit includes a footrest frame mounted adjustably on said extension member, and a footrest member supported by said footrest frame, said footrest frame being adjustable in height.

13. The breastfeeding chair as claimed in claim 1, wherein said seat unit further includes a waist support member provided between said backrest member and said seat member.

* * * * *